United States Patent [19]

Logie

[11] Patent Number: 4,553,121

[45] Date of Patent: Nov. 12, 1985

[54] CORE STRUCTURE FOR ELECTROMAGNETIC DEVICES

[75] Inventor: Frank M. Logie, London, England

[73] Assignee: Lucas Industries public limited company, Birmingham, England

[21] Appl. No.: 603,779

[22] Filed: Apr. 25, 1984

[30] Foreign Application Priority Data

May 13, 1983 [GB] United Kingdom ..... 8313170

[51] Int. Cl.[4] ..... H01F 7/08

[52] U.S. Cl. ..... 335/261; 335/279; 335/281

[58] Field of Search ..... 335/261, 279, 255, 266, 335/268, 281

[56] References Cited

U.S. PATENT DOCUMENTS 2,690,529 9/1954 Lindblad ..... 335/261 X
4,097,833 6/1978 Myers ..... 335/261
4,238,698 12/1980 Seilly et al. ..... 310/27
4,334,205 6/1982 Seilly ..... 310/27

*Primary Examiner*—George Harris

[57] ABSTRACT

An electromagnetic device comprises a stator structure having a central pole piece and axially spaced end pole pieces on opposite sides thereof. The device also includes an axially movable armature surrounding the stator structure and having a step which defines with said central pole piece an air gap extending in the direction of relative movement of the armature and stator structure. End portions of the armature define air gaps with the end pole pieces which extend normally to the axis of movement of the armature: The stator structure mounts a pair of windings on opposite sides of the central pole piece, the windings being connected so that when energized the magnetic flux due to the windings will flow in the same direction through the central pole piece.

1 Claim, 7 Drawing Figures

Figure 4:
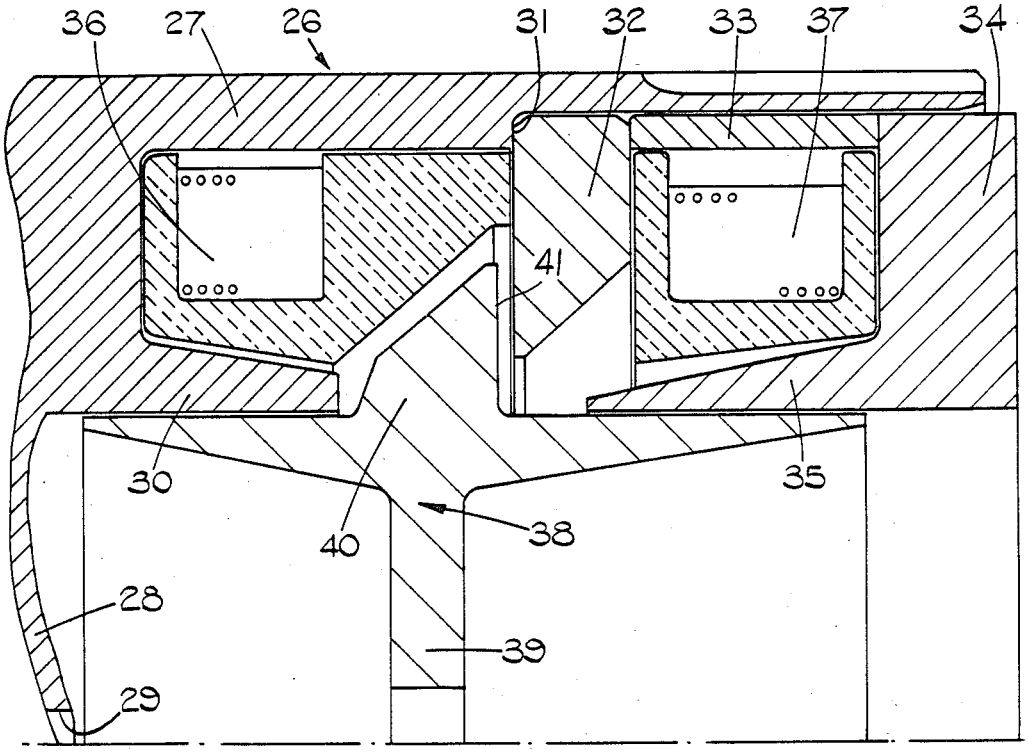

FIG. 1a. PRIOR ART
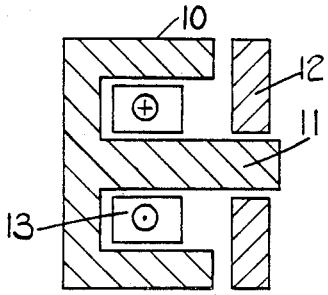
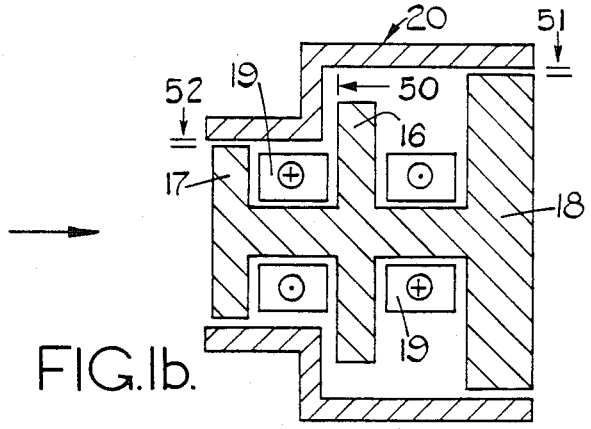
FIG. 1b.
FIG. 2a. PRIOR ART
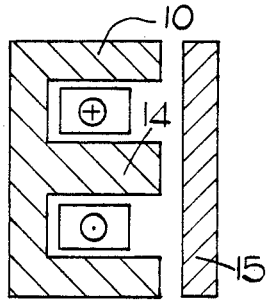
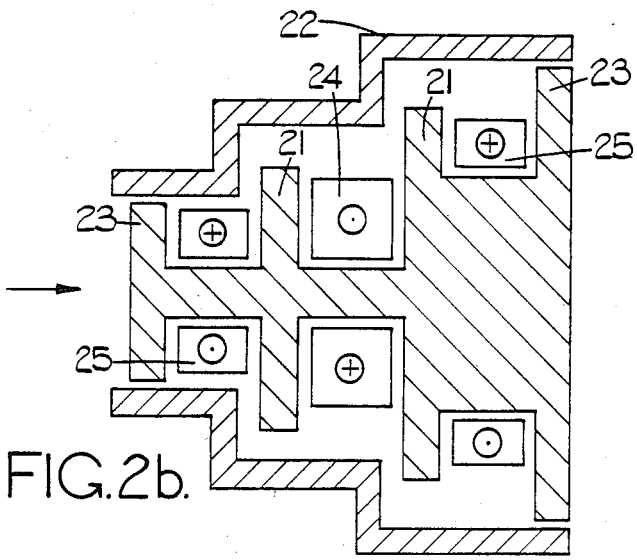
FIG. 2b.
FIG. 3a. PRIOR ART
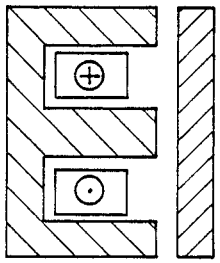
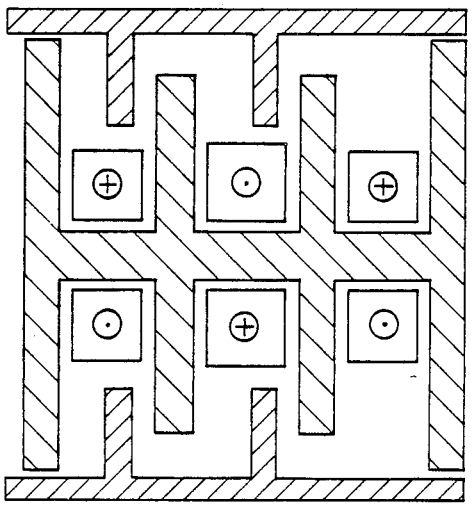
FIG. 3b

CORE STRUCTURE FOR ELECTROMAGNETIC DEVICES

This invention relates to electromagnetic devices of the kind comprising a core or stator structure, an armature movable relative to the core structure, at least one pole piece defined by said core structure, an energising winding wound about a part of the core structure and which when supplied with electric current drives magnetic flux through said pole piece, said pole piece defining a pole face between which and the armature magnetic flux can traverse an air gap extending in the direction of relative movement of the armature, and core structure and a return air gap defined between the armature and core structure.

The object of the invention is to provide an electromagnetic device of the kind specified in an improved form.

According to the invention in an electromagnetic device of the kind specified said return air gap extends in a direction substantially at right angles to the direction of relative movement of the core structure and armature, the core structure carrying a further winding for driving flux in the same direction through said pole piece as said first mentioned winding, the device including a further return air gap for the flux produced by said further winding, said further return air gap also extending in a direction substantially at right angles to the direction of relative movement of the core structure and armature.

The invention will now be described with reference to the accompanying diagrammatic drawings in which:

FIGS. 1–3 each show two views of electromagnetic devices, the devices on the left hand side of the figures being conventional devices and those on the right hand showing the modification of the conventional devices in accordance with the invention;

FIG. 1*a* shows a conventional electromagnetic core and armature with elongated inner pole piece;

FIG. 1*b* is a modification of the core and armature of FIG. 1*a* showing a stepped armature;

FIG. 2*a* shows a conventional electromagnet with the core outer and inner poles being of equal axial length;

FIG. 2*b* is a modification of FIG. 2*a* showing both radial and axial air gaps of a multi-stepped armature;

FIG. 3*a* shows a conventional electromagnetic device identical to FIG. 2*a;*

FIG. 3*b* is another modification of the electromagnetic device with the armature having inwardly extending ribs; and FIG. 4 shows a further modification of the present invention In the conventional device shown in FIG. 1 of the drawings the core structure is of annular form and of "E" section and defines an outer annular pole piece 10 and an inner pole piece 11 which extends beyond the pole piece 10 and which passes through an aperture in an armature 12. Surrounding the inner pole piece is a winding 13. The pole piece 10 defines an annular pole face which is presented to the armature, the air gap between the pole face and the armature extending in the direction of relative movement of the armature and core structure. The air gap between the inner pole piece 11 and the wall of the aperture in the armature extends in a direction at right angles to the direction of relative movement of the armature and core structure. When the winding is supplied with electric current the pole pieces 10 and 11 will assume opposite magnetic polarity with flux passing across the two air gaps. The flux which passes across the air gap defined between the pole face 10 and the armature 12 creates a force acting on the armature to move the armature towards the pole piece 10.

In the arrangement shown in FIG. 2*a* the inner pole piece 14 has the same axial length as the pole piece 10 and the armature 15 is not provided with an aperture. In this construction therefore two air gaps are again defined between the armature and the core structure but both air gaps extend in the direction of relative movement of the armature and core structure. Although as described the known devices shown in FIGS. 1 and 2, and the known device shown in FIG. 3*a* being the same as that shown in FIG. 2*a*, are of cylindrical shape, they need not be so and can be simple "E" cores.

The conventional devices have a simple magnetic circuit with a single winding to provide the MMF to generate the flux. Ignoring leakage flux the cross-section of the iron circuit for a specified flux density in the iron circuit, is determined by the pole gap cross-section and the required pole gap flux density.

Factors which limit the rate of increase of force and which therefore limit the rate of relative movement of the core structure and armature are the inductance or more specifically the inductive time constant which limits the rate of rise of current in the winding and the eddy-currents in the magnetic material which limit the rate of rise of flux therein. In attempting to obtain faster operation of the device the aim must be to minimise the inductive time constant and also the time required for the flux to penetrate the magnetic material known as the flux penetration time. The inductance is a function of the dimensions of the core, the material from which it is formed, the excitation level and the flux leakage. The flux penetration rate depends upon the material of the core and the excitation level and the flux penetration time depends upon the flux penetration rate and the iron circuit cross-section or the cross-section of the individual laminations if the iron circuit is laminated.

A solution to the problem is to provide flux for each pole piece which is associated with an air gap which decreases during relative movement of the armature and core structure, from two iron circuits and by this means for a given pole working area, flux density and leakage flux, the total iron area will remain constant and be divided between the two iron circuits. The section of each of the iron circuits thus formed is reduced as compared with the conventional construction and therefore there is a reduction in the time required for flux penetration to take place. An excitation winding is required for each iron circuit and the polarity of the MMF must be such that the resulting flux is additive in the pole piece which is associated with the air gap which reduces in length as relative movement of the core structure and armature takes place.

Referring now to FIG. 1*b* it will be seen that the core structure has been modified to provide a central annular pole piece 16 and a pair of outer pole pieces 17, 18. Windings 19 are wound in the gaps defined between the centre pole piece and the outer pole pieces. The armature 20 is of stepped hollow cylindrical form and overlaps in the radial direction, the pole piece 16. There is thus defined between the pole piece 16 and the step in the armature, an axially extending air gap 50 but between the armature and the pole pieces 17, 18 radial air gaps 51, 52 exist the dimensions of which do not change as relative movement of the armature and core structure take place. The windings are connected in series opposition and each winding when supplied with electric current, induces flux in its magnetic circuit and the flux from the two iron circuits is additive in the pole piece 16. For a given excitation current each winding 19 will have approximately the same number of turns as the winding 13.

If the winding dimensions are the same for the two constructions, then in the case of the modified arrangement the resistance of the two windings 19 will be twice that of the winding 13. However, the series inductance of the two windings will be less than twice that of the single winding because of the mutual inductance between the two windings. Because the inductance of the two windings is less than twice that of the single winding but the resistance is doubled, the inductive time constant will be less than that for a single coil.

Referring now to FIG. 2*b* two annular pole pieces 21 form the equivalent of the pole pieces 10 and 14 and the armature 22 is shaped to define portions presented to the sides of the pole pieces 21 to define the axially extending air gaps. The core structure is also provided with two further pole pieces 23 which define radially extending air gaps with the armature. A winding 24 is disposed in the groove defined between the pole pieces 21 and windings 25 are defined between the pole pieces 23 and the pole pieces 21. The three windings are again connected in series with the direction of current flow in adjacent windings being opposite. The pole pieces 21 when the windings are energised, assume opposite magnetic polarity but each pole piece 21 receives flux from two magnetic circuits one of which is common to the two pole pieces. In this case the windings 25 have half the number of turns of the winding 24.

The modified construction shown in FIG. 3*b* is essentially the same as that shown in FIG. 2*b*, the difference being the fact that the armature is of generally right cylindrical form with inwardly extending ribs as opposed to the steps of the armature shown in FIG. 2*b*.

A modification of the construction shown in the right hand drawing of FIG. 1*b* is shown in FIG. 4. In this case the armature is located within the core structure. The core structure 26 comprises a hollow cup shaped body 27 in the base wall 28 of which there is formed an aperture 29. The base wall also carries an axially extending annular projection 30 the radially inner surface of which is of right cylindrical form. The radially outer wall of the projection 30 is inclined inwardly away from the base wall. The skirt of the body 27 defines a step 31 against which is located an annular core pole 32. The pole is held in position by a tubular member 33 which in turn is held in position by an end closure member 34 which is retained in the open end of the body 27 in any convenient manner. The closure member has an integral and axially extending annular projection 35 having a radially inner surface of right cylindrical form and an outer radial surface which is inclined inwardly away from the closure member. All the components thus far described are formed from magnetizable material.

Surrounding the projections 30 and 35 are windings 36, 37 respectively these being carried on respective bobbins. The windings are conveniently connected in series with the direction of current flow being such that when electric current flows in the windings the stator pole 32 assumes one magnetic polarity and the projections the opposite polarity. The number of turns in each winding is the same.

Slidable within the core structure is an armature 38 which is of generally hollow cylindrical form having a right cylindrical outer surface which is sized so that it can slide relative to the internal surfaces of the projections 30 and 35. The armature has an internal rib 39 which has a central aperture whereby it can be connected to an output member (not shown) which extends through the aperture 29. The armature has an external rib 40 having a radial face 41 presented to a radial face of the core pole 32. The other sides and end faces of the rib 40 and the pole 32 are shaped to minimise flux leakage and also in the case of the armature, to reduce its mass. Moreover, the inner surfaces of the armature taper outwardly from the internal rib again to reduce the mass. It will be appreciated that the core structure has to be assembled in stages about the armature.

British Published Applications Nos. 2036453A and 2105912A disclose electromagnetic devices similar to the modified devices shown in FIGS. 1 and 2. The devices shown in the published specifications are however provided with more pole pieces but in each case it will be noted that the end pole pieces define axially extending air gaps with the armature and in a practical arrangement it is the practice to provide the end air gaps of reduced area in an attempt to maintain the flux density in the gap.

The disadvantage of this arrangement is that the division of flux between the gap (useful flux) and the leakage paths (leakage flux), depends on the ratio of gap reluctance to the leakage reluctance associated with the gap. The leakage reluctance does not vary much with the gap overlap while the gap reluctance is inversely proportional to the gap overlap. The result is that there is reduced pole efficiency. Another factor which further reduces the efficiency of the outer poles is the increase in leakage caused by the surrounding magnetic material extraneous to the magnetic circuit. By modifying the outer poles so that they define radial air gaps a substantial improvement in the performance of the device can be obtained. Moreover, the leakage of flux is minimised.

The radial air gaps should be as small as possible and may be so small as to constitute bearings to support the armature relative to the core structure. A suitable bearing material may be disposed between the pole pieces and the armature.

I claim:

1. An electromagnetic device comprising a core or stator structure, an armature movable relative to the core structure, at least one pole piece defined by said core structure, an energising winding wound about a part of the core structure and which when supplied with electric current drives magnetic flux through said pole piece, said pole piece defining a pole face between which and the armature magnetic flux can traverse an air gap extending in the direction of relative movement of the armature, and core structure and a return air gap defined between the armature and core structure, characterised in that said return air gap extends in a direction substantially at right angles to the direction of relative movement of the core structure and armature, the core structure carrying a further winding for driving flux in the same direction through said pole piece as said first mentioned winding, the device including a further return air gap for the flux produced by said further winding, said further return air gap also extending in a direction substantially at right angles to the direction of relative movement of the core structure and armature.

* * * * *